US008994258B1

(12) United States Patent
Kaufman et al.

(10) Patent No.: US 8,994,258 B1
(45) Date of Patent: Mar. 31, 2015

(54) END-HALL ION SOURCE WITH ENHANCED RADIATION COOLING

(71) Applicants: Harold R. Kaufman, Laporte, CO (US); James R. Kahn, Ft. Collins, CO (US); Richard E. Nethery, Windsor, CO (US)

(72) Inventors: Harold R. Kaufman, Laporte, CO (US); James R. Kahn, Ft. Collins, CO (US); Richard E. Nethery, Windsor, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 0 days.

(21) Appl. No.: 13/998,044

(22) Filed: Sep. 25, 2013

(51) Int. Cl.

| | |
|---|---|
| ***H01J 27/02*** | (2006.01) |
| ***H01J 27/18*** | (2006.01) |
| ***H01J 7/24*** | (2006.01) |
| ***H01J 9/18*** | (2006.01) |
| ***H01J 27/14*** | (2006.01) |

(52) U.S. Cl.
CPC ..... *H01J 27/022* (2013.01); *H01J 27/146* (2013.01); *H01J 9/18* (2013.01)
USPC ..... 313/361.1; 313/231.31; 313/359.1; 315/111.41; 315/111.61; 315/111.81

(58) Field of Classification Search
USPC ..... 313/359.1–363.1, 231.01–231.71; 315/111.41, 111.61, 111.81
See application file for complete search history.

(56) References Cited

U.S. PATENT DOCUMENTS

| | | | | |
|---|---|---|---|---|
| 4,862,032 | A | 8/1989 | Kaufman et al. | |
| 6,454,910 | B1 | 9/2002 | Zhurin et al. | |
| 6,608,431 | B1 * | 8/2003 | Kaufman | 313/231.31 |
| 6,750,600 | B2 * | 6/2004 | Kaufman et al. | 313/361.1 |
| 7,312,579 | B2 * | 12/2007 | Zhurin | 315/111.41 |
| 7,342,236 | B2 | 3/2008 | Burtner et al. | |
| 7,566,883 | B2 | 7/2009 | Burtner et al. | |
| 7,667,379 | B2 | 2/2010 | Kaufman et al. | |
| 2007/0273289 | A1 * | 11/2007 | Burtner et al. | 315/111.91 |

OTHER PUBLICATIONS

Clausing et al., Thermal Contact Resistance in a Vacuum Environment, May 1965; pp. 243-250; ASME; USA.
Yovanovich, Four Decades of Research on Thermal Contact, Gap, and Joint Resistance in Microelectronics; pp. 182-206; vol. 28 No. 2, Jun. 2005; IEEE USA.
Negus, Constriction Resistance of Circular Flux Tubes . . . ; 1984; pp. 1-6; 84-HT-84; ASME USA.
Kaufman, End-Hall Ion Source; Jul./Aug. 1987, J.Vac.Sci. Technol. A5 (4); pp. 2081-2084; USA.
Kaufman, Broad-beam Ion Sources; Jan. 1990, pp. 230-235; Rev. Sci. Instrum. 61 (1); USA.
Mahoney, A New End-Hall Ion Source With Improved Performance; 2006; pp. 706-711; 49th Annual Technical Conference Proceedings ISSN 0737-5291 USA.
Bejan, Heat Transfer Handbook; Chapter 4 (by Yovanovich); pp. 261-393; 2003; John Wiley & Sons, Inc, Hoboken, NJ USA.
Veeco; Tech. Manual Mark II Fluid Cooled Ion Source; 2006; pp. 1-76; Veeco Instruments Inc, Ft. Collins, CO USA.

* cited by examiner

*Primary Examiner* — Mariceli Santiago
(74) *Attorney, Agent, or Firm* — Dean P. Edmundson

(57) ABSTRACT

In accordance with one embodiment of the present invention, an end-Hall ion source has an electron emitting cathode, an anode, a reflector, an internal pole piece, an external pole piece, a magnetically permeable path, and a magnetic-field generating means located in the permeable path between the two pole pieces. The anode and reflector are enclosed without contact by a thermally conductive cup that has internal passages through which a cooling fluid can flow. The closed end of the cup is located between the reflector and the internal pole piece and the opposite end of the cup is in direct contact with the external pole piece, and wherein the cup is made of a material having a low microhardness, such as copper or aluminum.

17 Claims, 10 Drawing Sheets

END-HALL ION SOURCE WITH ENHANCED RADIATION COOLING

FIELD OF INVENTION

This invention relates generally to ion and plasma sources, and more particularly it pertains to end-Hall ion sources in which ions are accelerated by a direct current discharge within a quasi-neutral plasma.

BACKGROUND

End-Hall ion sources are used in a wide range of industrial applications. They are subject to a variety of heating and maintenance problems. The object of this invention is an end-Hall ion source that is easy to maintain when operated at high power.

Ions are generated by electrons emitted from an electron emitting cathode that is operated at a potential near ground. Ground is defined here as the potential of the surrounding vacuum chamber, which is usually (but not always) the same as earth ground. The electrons are attracted to the anode, which is at a positive voltage relative to ground—from several tens of Volts positive up to several hundreds of Volts positive. As the electrons enter the discharge region enclosed by the anode, they gain sufficient kinetic energy to ionize atoms or molecules of the ionizable working gas. The electrons are prevented from directly reaching the anode by a magnetic field between the internal pole piece and the external pole piece. Because of the magnetic field the electrons follow a long path in the discharge region before reaching the anode, thereby permitting operation at a much lower pressure for the ionizable working gas than would be possible without the magnetic field. Some of the ions generated in the discharge region escape out the open end of this region toward the electron emitting cathode and, together with some of the electrons emitted from this cathode, form a neutralized ion beam. "Neutralized" here refers to nearly equal densities of electrons and ions, not the recombination of the electrons and ions.

There is a reflector between the anode and the internal pole piece that defines the internal end of the discharge region. This reflector is electrically isolated and "floats" at a voltage intermediate of the anode and ground. This intermediate potential avoids the excessive erosion of the reflector that would take place if it were at ground potential, as well as the excessive loss of ionizing electrons if it were at anode potential. This reflector has been called a gas distribution plate or distributor, for its function in distributing the ionizable working gas. It has also been called a reflector, for its role in reflecting and conserving the ionizing electrons. It will be called a "reflector" herein. The ion source is enclosed by the return path for the magnetic field between the internal and external pole pieces. This enclosure also serves to exclude the electrons and ions that exist in the vacuum chamber outside of the ion source. These electrons and ions would otherwise cause damaging and performance-degrading arcs between electrodes inside the ion source. The enclosure also serves to exclude particles which would otherwise be deposited inside the ion source and result in a more rapid coating and degradation of insulators. The magnetic field could be generated by an electromagnet, but is usually generated by a permanent magnet adjacent to, or incorporated with, the internal pole piece.

A variety of operating and maintenance problems are encountered with these ion sources. Many of the problems have to do with heating. The energy input to the ion source is mostly from the discharge energy, that is, the current to the anode times the potential of the anode. Some additional energy is required to generate electrons, either the heating power for a hot-filament, cathode or the discharge power in a hollow-cathode type of cathode. Excessive heating can demagnetize the permanent magnet. It can also cause melting of the anode or reflector. Various cooling techniques have been used to avoid the problems caused by excessive heating. But these cooling techniques have often caused new problems. There have been cooling lines (carrying liquid coolant) that must be opened to perform maintenance, then re-connected to resume operation, with the possibility of cooling-line leaks in the vacuum chamber from the opening and re-connecting of these lines. Cooling the anode directly requires voltage isolation in the cooling lines, with the added problems of degradation of the insulator used and the enhanced erosion in the cooling lines caused by the applied voltage. Indirect cooling of the anode involves the conduction of heat through thin layers of insulation which, depending on the insulator, are easily broken or penetrated. It can also be difficult to maintain reliable heat transfer through thin layers of insulators due to poor thermal conductivity or poor thermal contact. As an additional source of problems, maintenance by the ion-source user can sometimes be carried out without regard for the manufacturer's instructions.

SUMMARY OF INVENTION

In light of the foregoing, it is a general object of the invention to provide an end-Hall ion source that is reliable, easy to maintain, and can operate at high discharge power without damage to its components.

A specific object of the invention is to provide an end-Hall ion source that does not require the opening of coolant lines to perform maintenance on the ion source.

Another specific object of the invention is to provide an end-Hall ion source that does not require additional thin layers of material between parts to enhance heat transfer between the parts, wherein the thin layers are easily omitted or damaged during maintenance.

Yet another specific object of the invention is to provide an end-Hall ion source that does not require thin layers of electrical insulation between parts to electrically isolate the parts, wherein the thin layers of insulation are easily damaged during maintenance.

Still another specific object of the invention is to provide an end-Hall ion source that does not require conduction cooling of parts at elevated electrical potentials such as the anode and reflector.

A still further specific object of the invention is to provide an end-Hall ion source with adequate cooling of the anode and reflector at high operating power using only radiation cooling of these parts.

Another still further specific object of the invention is to provide an end-Hall ion source in which the clamping force between heat-transfer surfaces increases as the temperatures of those parts increases.

In accordance with one embodiment of the present invention, an end-Hall ion source has an electron emitting cathode, an anode, a reflector, an internal pole piece, an external pole piece, a magnetically permeable path, and a magnetic-field generating means located in the permeable path between the two pole pieces. The anode and reflector are enclosed without contact by a thermally conductive cup that has internal passages through which a cooling fluid can flow. The closed end of the cup is located between the reflector and the internal pole piece and the opposite end of the cup is in direct contact with the external pole piece, and wherein the cup is made of a material having a low microhardness, such as copper or aluminum.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

FIG. 7(*b*) shows the prior-art cross section of the joint in FIG. 5 when the joint studied is rough and conforming;

FIG. 7(*c*) shows the prior-art cross section of the joint in FIG. 5 when the joint studied is rough and nonconforming;

FIG. 8(*b*) shows the prior-art physical contact for the joint in FIG. 5 when the joint studied is rough and conforming;

FIG. 8(*c*) shows the prior-art physical contact for the joint in FIG. 5 when the joint studied is rough and nonconforming;

FIG. 17(*b*) shows the local cross section of an end-Hall ion source otherwise similar to that in FIG. 16 in which cylinder 654 has been replaced with cylinder 654A and which further has a layer of low microhardness material 654B permanently attached to cylinder 654A;

DESCRIPTION OF ION-SOURCE PRIOR ART

Figure 1:
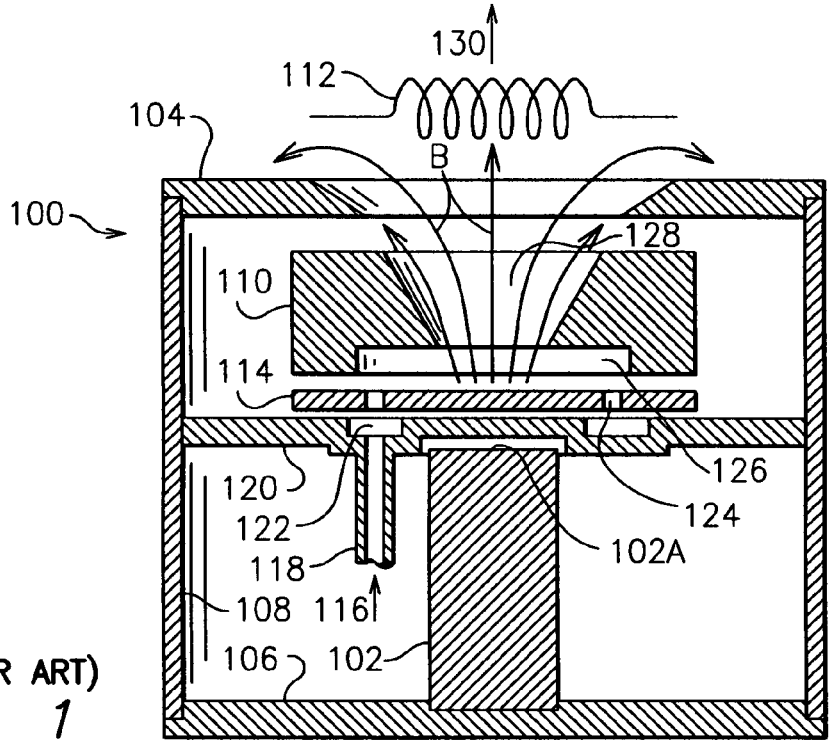
(PRIOR ART) Fig. 1
FIG. 1 shows the cross section of a prior-art end-Hall ion source, in which cooling is by radiation.

Referring to FIG. 1, there is shown prior-art end-Hall ion source 100. This source has magnetic-field energizing means 102, which in FIG. 1 is a permanent magnet. The magnetic-field energizing means could also be an electromagnet, although permanent magnets are more common for this function. The top of permanent magnet 102 performs the function of internal pole piece 102A. The internal pole piece could also be a separate piece of magnetically permeable material located on top of permanent magnet 102. The magnetic circuit includes magnetically permeable external pole piece 104, magnetically permeable base plate 106, and magnetically permeable cylindrical wall 108. The magnetic circuit with the magnetic-field energizing means generates magnetic field B between internal pole piece 102A and external pole piece 104. Variations in the magnetic circuit are possible without significantly affecting magnetic field B or the performance of the ion source.

Between internal pole piece 102A and external pole piece 104 is anode 110. On the opposite side of external pole piece 104 from the anode is electron emitting means 112. Electron emitting means 112 is shown as a hot filament, typically a tungsten or tantalum wire. It could also be a hollow cathode, as described in U.S. Pat. No. 7,667,379—Kaufman, et al. It could even be a separate piece of equipment in the vacuum chamber, a magnetron for example in U.S. Pat. No. 6,454,910—Zhurin, et al. Between anode 110 and internal pole piece 102A is reflector 114. The reflector is also called a gas distribution plate or distributor, as mentioned in the Background section. Ionizable gas 116 is introduced through gas tube 118, attached to central plate 120. The gas flows into gas distribution volume 122, through a plurality of apertures 124 in the reflector, into recess 126 in anode 110, and then into discharge volume 128.

In operation, electron emitting means 112 is at a potential close to ground, the potential of the surrounding vacuum chamber. The surrounding vacuum chamber is not shown in FIG. 1. As described in the Background section, the vacuum chamber is usually (but not always) at earth ground. Anode 110 is at a positive potential relative to ground—from several tens of Volts positive up to several hundreds of Volts positive. The electrons are attracted to the positive potential of anode 110. As the electrons enter discharge region 128 enclosed by anode 110, they gain sufficient kinetic energy to ionize atoms or molecules of ionizable working gas 116. The electrons are prevented from directly reaching the anode by magnetic field B generated between internal pole piece 102A and external pole piece 104. Because of magnetic field B the electrons follow a long, cycloidal path in discharge region 128 before reaching anode 110, thereby permitting operation at a much lower pressure for the ionizable working gas in discharge region 128 than would be possible without the magnetic field. Some of the ions generated in the discharge region escape out the open end of this region toward electron emitting means 112 and, together with some of the electrons emitted from electron emitting means 112, form neutralized ion beam 130. As mentioned in the Background section, "neutralized" here refers to nearly equal densities of electrons and ions, not the recombination of the electrons and ions. Although the generation of ions from an ionizable gas and the acceleration of these ions into a neutralized beam of ions may differ in some details from those processes in the other end-Hall ion sources described herein, those processes are similar in all important aspects to the processes described in this paragraph. Additional details of the operation of these ion sources are described in an article by Kaufman, et al., in the *Journal of Vacuum Science and Technology A*, Vol. 5 (1987), beginning on page 2081, and in U.S. Pat. No. 4,862,032—Kaufman, et al. These publications are incorporated herein by reference.

The maximum beam energy (ion-beam current times ion-beam energy) of an end-Hall ion source is limited by heating and the damage caused by that heating. Most of the heat comes from the discharge to anode 110. A smaller amount comes from the electron emitting means 112. If the electron emitting means is a hollow cathode, as described in the aforesaid U.S. Pat. No. 7,667,379 by Kaufman, et al., the heating from the electron emitting means is quite small compared to the anode discharge. In addition, the heat from the electron emitting means is radiated in all directions, with most of it going to other than the ion source.

The useful energy is in the ion beam. It is instructive to consider the fraction of the discharge energy that leaves in the ion beam. For a typical 150 V discharge, the mean ion energy is about 90 eV (electron-Volts). This means that the ion energy is the same as if they "fell" through a potential difference of 90V. In addition, energy was used in ionizing the working gas that leaves as ions. For the common working gas of argon, this would be 15.76 eV per ion, making a total useful energy of 105.76 eV per ion. The total ion-beam current is equal to about 20 percent of the discharge current. For a 5 A, 150 V discharge, the useful energy (energy used in creating and accelerating the ions) is a 1 A ion beam times 105.76 V, or 106 W. Thus, about 14 percent goes into the ion beam and most of the other 86 percent heats the anode and reflector. In the apparatus shown in FIG. 1, the anode and reflector are cooled by radiation. Some of this radiation can escape through the central aperture in external pole piece, leaving roughly 75-80 percent of the discharge power to heat surrounding ion-source parts: external pole piece 104, cylindrical wall 108, and central plate 120. These elements in turn radiate to other ion-source elements and to the surrounding vacuum chamber. In reaching temperatures intermediate of the hot anode and reflector and the cooler vacuum-chamber environment, elements 104, 108, and 120 serve as radiation shields, thereby causing the anode and reflector temperatures to increase compared to the temperatures these parts would have if elements 104, 108, and 120 were not present. As is described in more detail in the Description of Heat Transfer Prior Art section, conduction between parts that are nominally in contact tends to be much smaller in a vacuum environment than in a normal atmospheric environment. In general, unless a mechanical joint has specifically been designed to increase thermal conduction, the thermal conduction is a negligible process in the cooling of an end-Hall ion source.

With the heating as described above, the damage due to operating at an excessive power can be in the form of melting for anode 110 or reflector 114. Assuming the magnetic-field generating means is a permanent magnet, the magnet can also be damaged by approaching the Curie temperature, at which it is demagnetized. One or more of these three forms of damage typically limit the operating power of an end-Hall ion source. Which one will be the limit in a particular ion source will depend on design details for that source.

The ion source shown in FIG. 1 has maintenance requirements. These requirements can vary with the application for which the ion source is used, but often include removing an electrically insulating coating on the anode, replacing insulators in the ion source (used to separate components that operate at different voltages) that have become coated with conducting layers, replacing an eroded reflector, and generally removing deposited films that can break loose and cause arcing and contamination of work pieces. The cleaning of surfaces during maintenance is often done with abrasive blasting, in which abrasive particles are blown at surfaces with compressed air. Abrasive blasting leaves a roughened surface that tends to prevent peeling of layers that are subsequently deposited. But it is often carried out by hourly workers that may do a poor job, or even abrasive blast surfaces that don't need cleaning.

Process rates in industrial applications often depend on the power level at which an ion source is operated. In attempts to increase process rates, ion sources are often damaged by operation at excessive power levels. The damage is from overheating and, as described above, tends to be melting of the anode or reflector or demagnetizing the permanent magnet. Correcting the damage caused by overheating can also be a part of maintenance, although it shouldn't be considered part of routine maintenance.

In describing the advantages and disadvantages of the end-Hall ion source, there should also be a mention of the alternative technology of gridded ion sources, as described in an article by Kaufman in the *Review of Scientific Instruments*, Vol. 61 (1990), beginning on page 230. There are differences in operating ranges between end-hall ion sources and gridded ion sources that are of interest to the users of the respective ion-source types. What is more pertinent here is that gridded ion sources use gridded ion optics, which require precise alignment and are easily damaged. In comparison to gridded ion sources, as exemplified by the apparatus shown in FIG. 1, end-Hall ion sources are simple, reliable, and easily maintained. More specifically, the maintenance does not require any special care or skills.

Figure 2:
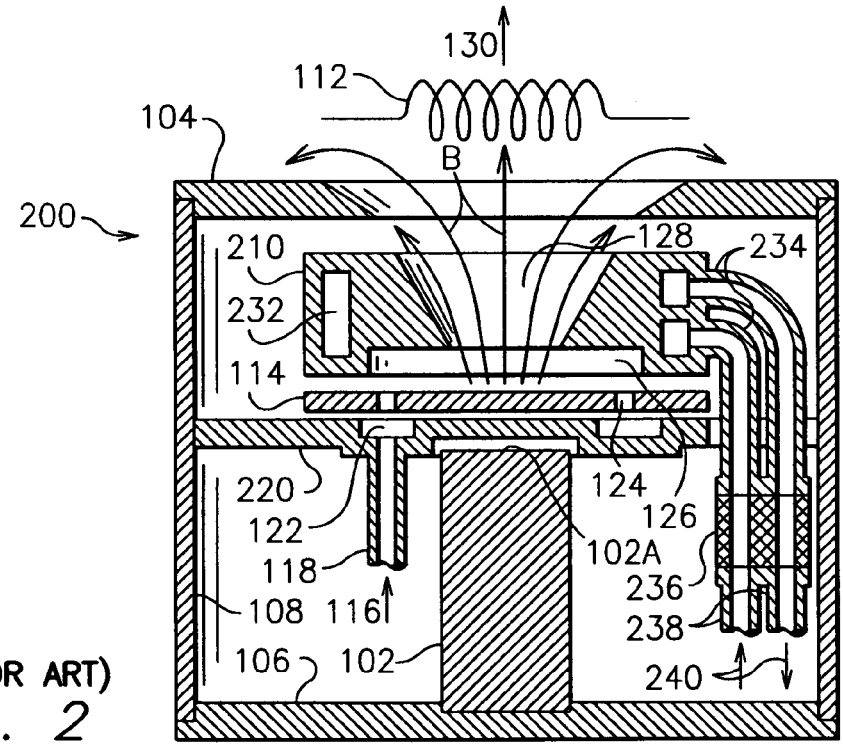
(PRIOR ART) Fig. 2
FIG. 2 shows the cross section of a prior-art end-Hall ion source, in which the anode is cooled directly by a fluid flowing through internal passages.

Referring to FIG. 2, there is shown prior-art end-Hall ion source 200, in which anode 210 is cooled directly by a fluid flowing through internal passages. Central plate 220 differs only in being modified to accommodate the anode cooling. Cooling passages 232 in anode 210 are connected to anode tubes 234, cooling isolator 236 and supply tubes 238. Cooling fluid 240 flows through all of these to cool anode 210. Anode tubes 234 and supply tubes 238 are customarily made of stainless steel to avoid contaminating the vacuum environment. Cooling isolator 236 is constructed of a ceramic insulator and is necessary because cooling fluid 240 is normally supplied to the ion source through tubes (in this case supply tubes 238) at ground potential. Cooling isolator 236 serves to electrically isolate the positive potential of anode 210 from ground potential. All other elements in FIG. 2 function as described in connection with FIG. 1.

While the apparatus shown in FIG. 2 can be effective in cooling the anode and increasing the permissible operating power for the ion source, it also requires more routine maintenance compared to the radiation cooled design shown in FIG. 1. When the cooling fluid is mostly or entirely water, as it usually is, the potential difference across cooling isolator 236 tends to degrade the surfaces of the cooling isolator that are in contact with the cooling fluid. The ends of anode tubes 234 and supply tubes 238 closest to cooling isolator 236 are also subject to increased erosion due to the potential difference across the cooling isolator. In addition, supply tubes 238 must be opened to perform maintenance, then reconnected to resume operation after maintenance. The opening and reconnecting of cooling lines is always undesirable in a vacuum chamber because of the increased possibility of cooling-line leaks during a subsequent pumpdown.

Figure 3:
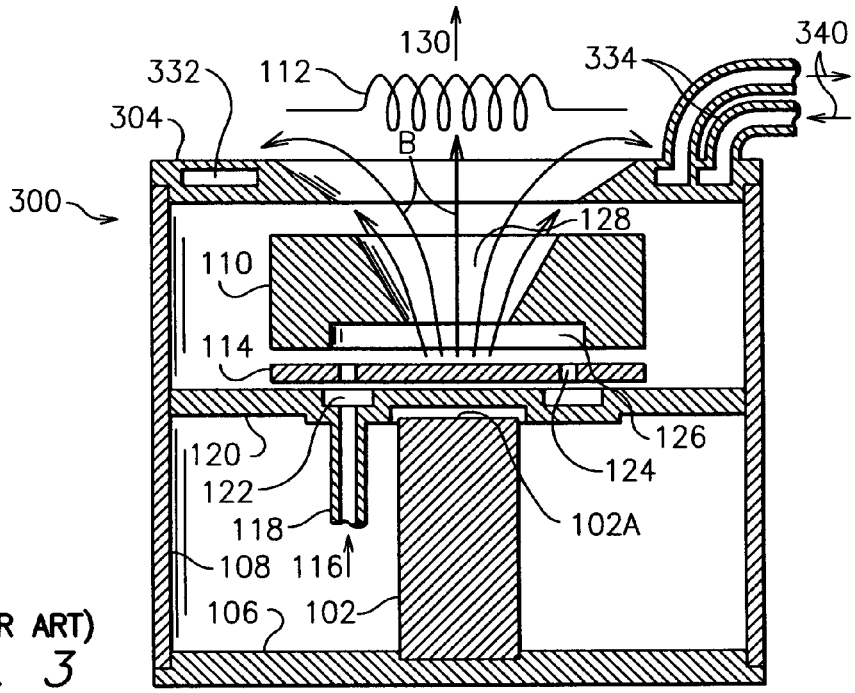
(PRIOR ART) Fig. 3
FIG. 3 shows the cross section of a prior-art end-Hall ion source, in which the external pole piece is cooled directly by a fluid flowing through internal passages.

Referring to FIG. 3, there is shown prior-art end-Hall ion source 300, in which external pole piece 304 is cooled directly by a fluid flowing through internal passages. Cooling passages 332 in external pole piece 304 are connected to supply tubes 334. Cooling fluid 340 flows through the passages and tubes to cool external pole piece 304. All other elements in FIG. 3 function as described in connection with FIG. 1.

The apparatus shown in FIG. 3 can be effective in cooling the external pole piece, reducing the heat radiated to the ion-beam target from the ion source, and facilitating more rapid access to the ion source for maintenance. But the increase in permissible operating power for the ion source is much smaller than if the anode were cooled, as shown in FIG. 2. While it avoids the tube corrosion and cooling-isolator degradation associated with the apparatus shown in FIG. 2, it still has the shortcoming of having to open and reconnect water lines to perform maintenance on the ion source.

Figure 4:
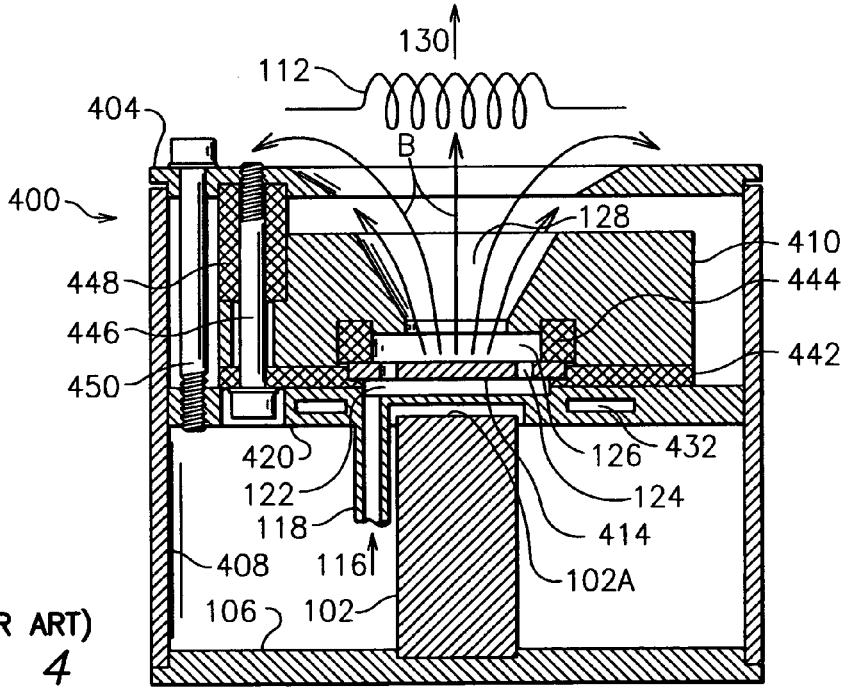
(PRIOR ART) Fig. 4
FIG. 4 shows the cross section of a prior-art end-Hall ion source, in which the anode is cooled indirectly by conduction to a central plate in which a fluid flows through internal passages.
Figure 9:
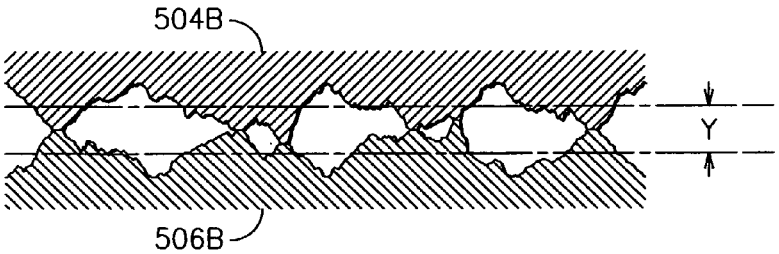
(PRIOR ART) Fig. 9
FIG. 9 shows a further enlarged cross section of the prior-art joint in FIG. 7(*b*)

Referring to FIG. 4, there is shown prior-art end-Hall ion source 400, in which the anode is cooled indirectly by conduction to a central plate that has a cooling fluid flowing through internal passages. This apparatus is described in U.S. Pat. No. 7,342,236—Burtner, et al. This publication is incorporated herein by reference. The apparatus shown in FIG. 4 corresponds to that in FIGS. 2 and 9 (FIG. 9 shows more detail) in the aforesaid U.S. Pat. No. 7,342,236 by Burtner, et al., and illustrates the conductive cooling of the anode through an electrically insulating layer, a central concept of the aforesaid invention. According to the aforesaid patent (see column 1, lines 33 through 49 therein), radiation cooling of this size of ion source is limited to discharge powers of about 1000 W. Direct conductive cooling of the anode, as in FIG. 2 herein, permits discharge powers as high as 3000 W. The objective in the aforesaid patent for this configuration (FIG. 4 herein, FIGS. 2 and 9 therein) is to use indirect conductive cooling of the anode through a "thermally conductive, electrically insulating" layer, thereby also permitting discharge powers of 3000 W. To show that the conduction of heat is referred to, not the radiation of heat, the word "radiation" appears only once in the aforesaid patent, in the aforementioned first-column citation, showing the limitation on power when using radiation cooling.

Still referring to FIG. 4, external pole piece 404 is modified slightly to accommodate screws used to improve heat transfer by clamping parts together. Cylindrical wall 408 is shortened slightly to accommodate the change in clamping. Anode 410 and reflector 414 are also modified to accommodate the change in clamping. Central plate 420 differs from central plate 120 by having internal passages 432 for the cooling fluid and accommodations for screw heads and threaded holes used in clamping. The supply tubes to bring and carry away the cooling fluid are not shown, but can be at ground potential and do not have to be opened and reconnected to carry out routine maintenance. An anode subassembly is comprised of anode 410, reflector 414, thermally conductive, electrically insulating thermal transfer interface component 442, ceramic isolator 444, a plurality of anode subassembly attachments 446 (screws), and a plurality of insulators 442. (The terms such as "thermally conductive, electrically insulating thermal transfer interface component" and "ceramic isolator" are used in the aforesaid U.S. Pat. No. 7,342,236 by Burtner, et al. and are used here to facilitate comparison.) A plurality of anode subassembly attachments 446 hold the anode subassembly together, while a plurality of insulators 448 keeps the anode from touching the external pole piece when anode subassembly attachments 446 are tightened. The anode subassembly is then attached to the ion source with a plurality of subassembly attachments 450. (Note that "subassembly attachments" are different from "anode subassembly attachments.")

The apparatus shown in FIG. 4 has maintenance shortcomings. These shortcomings result from poor thermal conduction across joints in vacuum, which will be described later in more detail and from a more fundamental heat-transfer viewpoint. These shortcomings are more evident in the commercial product that is based on the aforesaid U.S. Pat. No. 7,342,236 by Burtner, et al., and marketed by the assignee as the Mark II$^{\oplus}$ Ion Source. The performance of this commercial product is described by Mahoney, et al., in an article in the 49*th Annual Technical Conference Proceeding* (2006) beginning on page 706, while the maintenance of this commercial product is described in an anonymous technical manual, *Manual* #427366 *Rev B* (2006). Thermally conductive, electrically insulating thermal transfer interface component 442 in FIG. 4 herein becomes the "thermal transfer plate" in the aforesaid anonymous technical manual. These publications are incorporated herein by reference.

Materials that are good electrical insulators and have acceptable thermal conductivity to perform the combined thermal-conduction/electrical-insulation function of this component, such as aluminum nitride and boron-nitride, tend to be brittle and easily broken. On page 36 in the aforesaid anonymous technical manual it is stated that "The thermal transfer plate breaks easily if dropped or shocked. Handle them [sic] carefully to avoid part damage." At the same time, brittle materials do not conform well at heat-transfer joints, resulting in poor heat transfer at a joint in a vacuum environment. To improve the heat transfer in a vacuum joint with a brittle material, an additional thin layer of easily deformed material can be used. These are the "thermal transfer sheets" that are located on both sides of the thermal transfer plate (pages 35 and 36 in the aforesaid anonymous manual) and are described further on page 36, "The thermal transfer sheets tear easily." The thermal transfer sheets are also described in U.S. Pat. No. 7,566,883—Burtner, et al. During reassembly, pages 41 thru 43 in the aforesaid anonymous manual, a torque wrench is required for three separate steps in reassembly. On page 43, "To avoid damaging the thermal transfer plate and/or sheets, use the specified torque values." In addition to possible damage to other parts, the threaded parts themselves can be damaged by excessive torques, as also noted in the aforementioned anonymous technical manual, *Manual* #427366 *Rev B* (2006). (Those skilled in the art recognize that galling and seizing are more common in a vacuum environment than in an atmospheric environment when the same tightening torques are used for similar threaded parts.) Note that parts that are easily torn or broken and multiple uses of torque wrenches (three times during the reassembly described in the aforesaid anonymous technical manual) represent adverse departures from the simple, reliable, and easily maintained end-Hall ion source of FIG. 1.

The configuration of interest here is shown in FIG. 4 herein and FIG. 9 of the aforesaid U.S. Pat. No. 7,342,236 by Burtner, et al., wherein the anode is cooled indirectly by conduction, either in the configuration of the aforesaid patent or with the addition of the thermal transfer sheets as described in the aforementioned anonymous technical manual, *Manual* #427366 *Rev B* (2006). The performance of this source is described in the aforementioned article by Mahoney, et al., in the 49*th Annual Technical Conference Proceeding* (2006), and compared to both the radiation-cooled end-Hall ion source (FIG. 1 herein) and the direct-cooled anode (FIG. 2 herein). All of these ion sources have a nominal diameter of 14 cm, not counting the projection of a hollow cathode beyond the source diameter, so that there is no large difference in source size. The radiation-cooled source was limited to a discharge power of 875 W, due to the magnet approaching the Curie temperature where it would become demagnetized. Both the direct-cooled anode (FIG. 2 herein) and the indirect-conduction-cooled anode (FIG. 4 herein) were operated at the much higher power of 3000 W, with much lower magnet temperatures for both. There was also a switch in the electron emitting means from hot filaments to hollow cathodes for both sources when operated at 3000 W. The direct-cooled anode had a lower anode temperature of less than 500° C., compared to over 1000° C. for the indirect-conduction-cooled anode. The gas distributor (called the reflector herein) showed the opposite relationship with the distributor at over 600° C. for the indirect-conduction-cooled anode compared to over 1000° C. for that of the direct-cooled anode. In comparing these two configurations, which were also about the same diameter, the disadvantages of multiple fragile layers (both the thermally conductive, electrically insulating thermal transfer interface components of FIG. 4 and the thermal transfer sheets described in the aforementioned anonymous technical manual) can be balanced against the opening and reconnecting of cooling lines during maintenance.

The alternate embodiments in the aforesaid U.S. Pat. No. 7,342,236 by Burtner, et al. have shortcomings that should be obvious to one skilled in the art. For example, the embodiment shown in FIG. 7 therein uses isolators in the cooling lines (element 740 therein) that the same patent found objectionable in its description of prior art, see Col. 1 line 62 to Col. 2 line 3 therein. As another example the embodiment shown in FIG. 8 therein requires that the cooling cavity in the center plate (element 814 therein) be opened to perform routine maintenance; this is at least as undesirable as opening cooling lines.

Description of Heat-Transfer Prior Art

Figure 5:
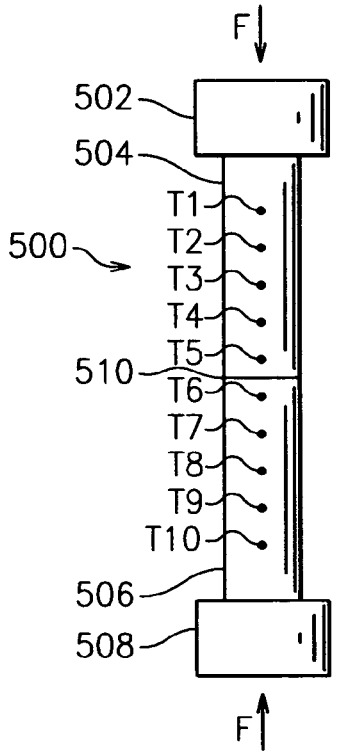
(PRIOR ART) Fig. 5
FIG. 5 shows the prior-art apparatus for measuring thermal contact resistance between two bodies in thermal contact.

The thermal resistances at joints in a vacuum environment are important in much of the preceding discussion. This was recognized in the statement in the aforesaid U.S. Pat. No. 7,342,236 by Burtner, et al., "Alternative methods of actively cooling the anode have been hampered by the traditional difficulties of transferring heat between distinct components in a vacuum." The measurement of the thermal resistance at joints is described by Clausing, et al. in an article in *Journal of Heat Transfer*, beginning on page 243 (May, 1965). This article is incorporated herein by reference. Referring to FIG. 5 herein, there is shown exemplar test equipment 500 used to study the contact resistance. Thermal source 502 supplies heat to first cylinder 504, while second cylinder 506 is cooled by heat sink 508. The first and second cylinders meet at joint 510, where they are held in contact with force F. The cylindrical sides of the first and second cylinders are typically covered with insulation, so that the only significant heat transfer is parallel to the cylinders.

Figure 6:
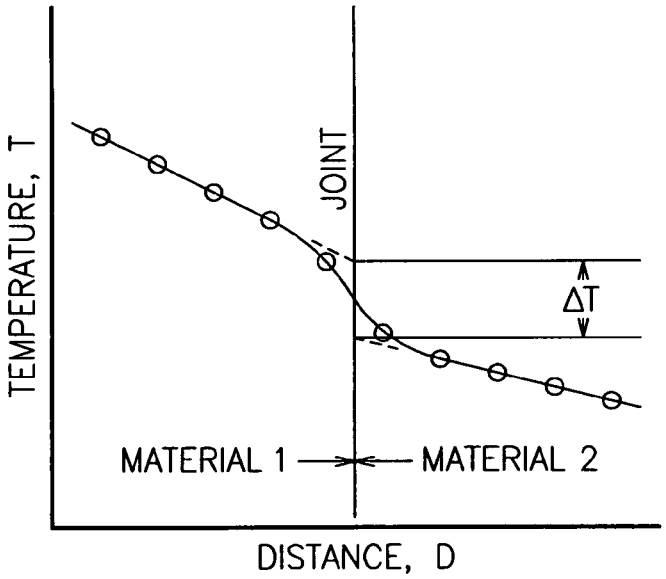
(PRIOR ART) Fig. 6
FIG. 6 shows how prior-art temperature measurements along the two bodies in FIG. 5 are used to measure the temperature difference due to the contact resistance.

After steady-state heat transfer is established, temperatures T1, T2, T3, etc. are measured and plotted in FIG. 6 against distance D, which is defined herein as the distance along cylinders 504 and 506 in FIG. 5. With uniform properties and cross sections along the cylinders, the temperatures vary in a linear manner with distance D, except near joint 510, where extrapolations of the linear variations (shown by the dashed lines) give a temperature difference, ΔT, due to the presence of the joint. Note that the linear variations are not the same for the two cylinders in FIG. 6, which would be expected if the cylinders are made of different materials.

Figure 7A:
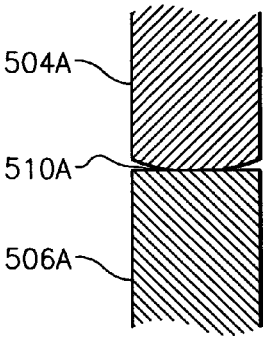
(PRIOR ART) Fig. 7(a)
FIG. 7(*a*) shows the prior-art cross section of the joint in FIG. 5 when the joint studied is smooth and nonconforming.
Figure 7B:
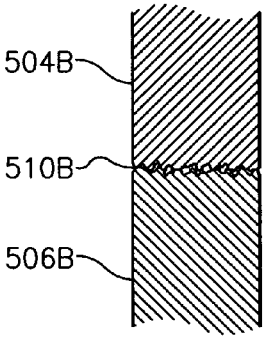
(PRIOR ART) Fig. 7(b)
Figure 7C:
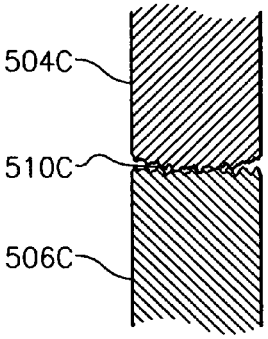
(PRIOR ART) Fig. 7(c)
Figure 8A:
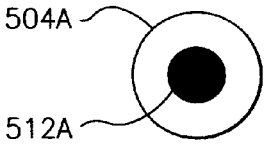
(PRIOR ART) Fig. 8(a)
FIG. 8(*a*) shows the prior-art physical contact for the joint in FIG. 5 when the joint studied is smooth and nonconforming.
Figure 8B:
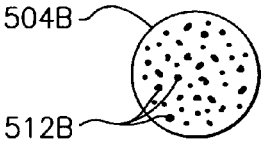
(PRIOR ART) Fig. 8(b)
Figure 8C:
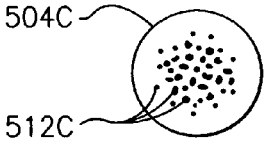
(PRIOR ART) Fig. 8(c)

As described in an article by Yovanovich in the *IEEE Transactions on Components and Packaging Technologies*, Vol. 28 (2005), beginning on page 182, the thermal resistance at a joint varies with the force that pushes the two members together (F in FIG. 5), the contours of the surfaces at the joint, the properties of the members in the joint, and the environment of the joint. This article is incorporated herein by reference. Referring to FIGS. 7(*a*), 7(*b*), and 7(*c*), there are shown typical surface contours. The contacting elements, element 504A and element 506A meeting at joint 510A in FIG. 7(*a*), element 504B and element 506B meeting at joint 510B in FIG. 7(*b*), etc. are all assumed to be in a test equipment environment similar to that shown in FIG. 5, and differ only in surface contours at the joints. The surfaces are smooth and nonconforming in FIG. 7(*a*), rough and conforming in FIG. 7(*b*), and rough and nonconforming in FIG. 7(*c*). The corresponding contact areas are shown in FIGS. 8(*a*), 8(*b*), and 8(*c*). The roughness sizes are enlarged in these figures, because they would be within the width of a printed line if they were drawn to scale.

The smooth contours shown in FIG. 7(*a*) are not practical for ion sources in an industrial vacuum environment. The loads are light, so that only the peaks of surface asperities are in contact. Further, careless handling during maintenance frequently roughens surfaces, whether or not the parts from the ion-source manufacturer are initially polished smooth. On the other hand, it is practical to design and fabricate parts that have conformal surfaces, as shown in FIG. 7(*b*). Referring to FIG. 9, there is shown a view of the cross section of FIG. 7(*b*) that is enlarged further. The contact of rough conforming element 504B and element 506B results in mean separation, Y, with only occasional contact between the two elements.

Figure 10:
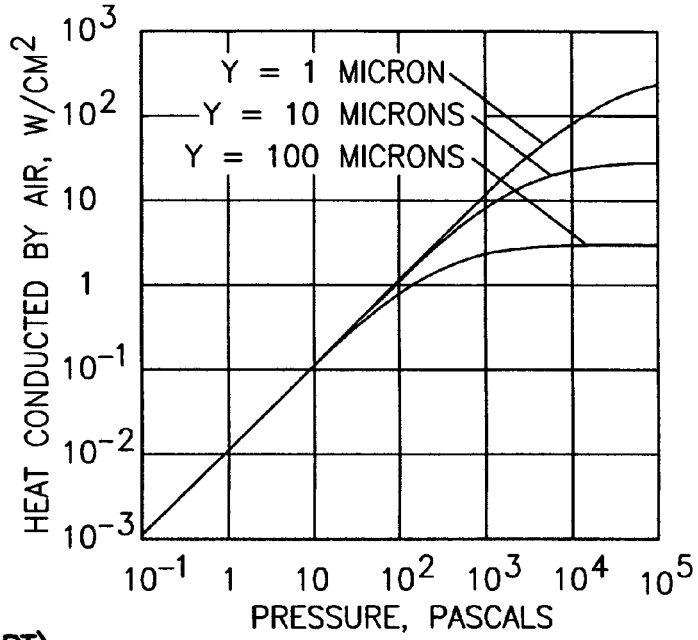
(PRIOR ART) Fig. 10
FIG. 10 shows the heat conducted across a prior-art joint for different mean plane separations, Y, different air pressures, a cold temperature of 25° C., and a hot temperature of 125° C.

The contact between elements shown in FIG. 9 and the environment of this contact affects the heat transfer between those elements. The effect of varying the atmospheric pressure on heat transfer at a joint with several values of mean separation, Y, is shown in FIG. 10 for a hot temperature of 125° C. and a cold temperature of 25° C. The calculation procedure used is described by Yovanovich, et al., in Chapter 4 of *Heat Transfer Handbook* (Bejan et al., eds.), John Wiley & Sons. Inc., Hoboken, N.J. (2003), beginning on page 261. One atmosphere is approximately $10^5$ Pa (Pascals). At pressures near one atmosphere, the heat conduction is sensitive to the mean separation, Y. Except for the smallest separation of 1 micron, the heat conduction at this pressure is insensitive to pressure. This lack of sensitivity can be understood by remembering that an increased pressure means more molecules are present to transport the heat, but the mean path length between molecular collisions decreases as the pressure increases, and more collisions are required to carry heat from one surface to the other.

The maximum background pressure for operating an end-Hall ion source is usually about 0.1 Pa, where the heat transported is only about $10^{-3}$ W/cm$^2$ for the conditions given. Note that the mean separation doesn't matter at very low pressures, because the mean path length for molecules is much greater than the mean separation, and only the gas pressure is important for the heat conduction. The heat transfers shown in FIG. 10 will vary with the background gas and specific temperatures that are used in the heat transfer calculations. But the gas conduction of heat will remain negligible for ion-source cooling at the pressures at which ion sources operate. Conversely, it is often the gas conduction that gives the normal expectation of heat transfer at a joint in an atmospheric environment.

Figure 11:
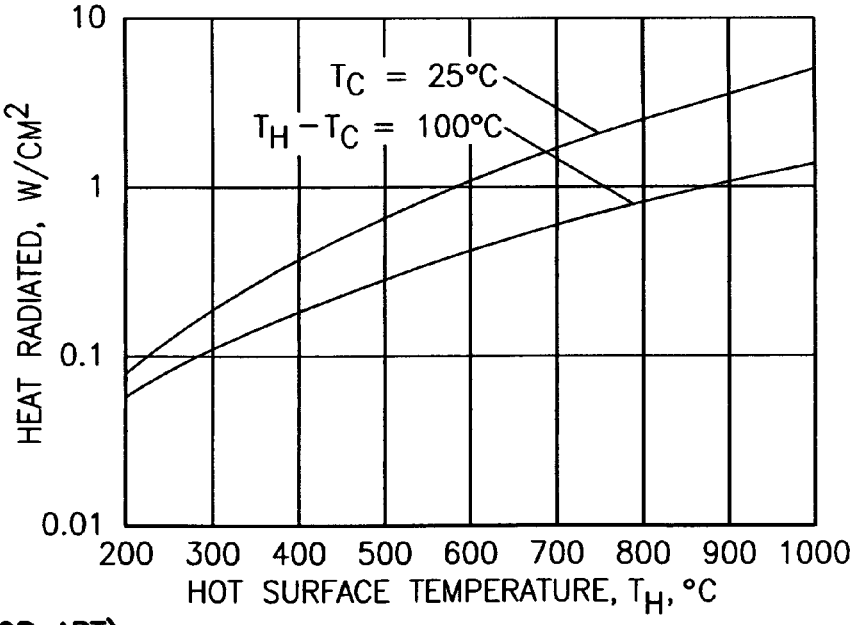
(PRIOR ART) Fig. 11
FIG. 11 shows the prior-art heat radiated across a joint for a cold temperature of 25° C., a cold temperature that is 100° C. colder than the hot temperature, and a range of hot temperatures.

Referring to FIG. 11, the heat transfer at a joint due to radiation is shown for a range of hot surface temperatures. Two cold surface temperatures are used, one held constant at 25° C. and the other varied to be 100° C. colder than the hot surface. The calculation of these heat transfers used the Stefan-Boltzmann radiation constant, emissivities and absorptivities of 0.5 (typical of rough surfaces), and a geometric configuration with two extended parallel surfaces. To carry away the heat generated in a high-power end-Hall ion source, the heat transfer should be several W/cm$^2$. The heat transferred by radiation is only a small fraction of that value for hot surface temperatures of 500° C. or less. Again, changes in the values used in the calculations for FIG. 11 would change the results, but not by enough to make radiation significant for heat transfer in an end-Hall ion source at hot-surface temperatures less than about 500° C.

The fundamental limitations on heat transfer in vacuum are illustrated by FIGS. 10 and 11. These results can be surprising to someone unskilled in vacuum technology. The gas conduction provided by an atmospheric environment in a mechanical joint is important and is missing in a vacuum environment. And, except at very high temperatures, little heat transfer takes place in a joint due to radiation. Unless easily damaged thermal transfer sheets are used to provide more contact area, as described in the aforesaid anonymous technical manual and the aforesaid U.S. Pat. No. 7,566,883—Burtner, et al., the heat transfer at a joint in a vacuum environment is typically determined by a physical contact similar to that indicated in FIG. 9.

Figure 12:
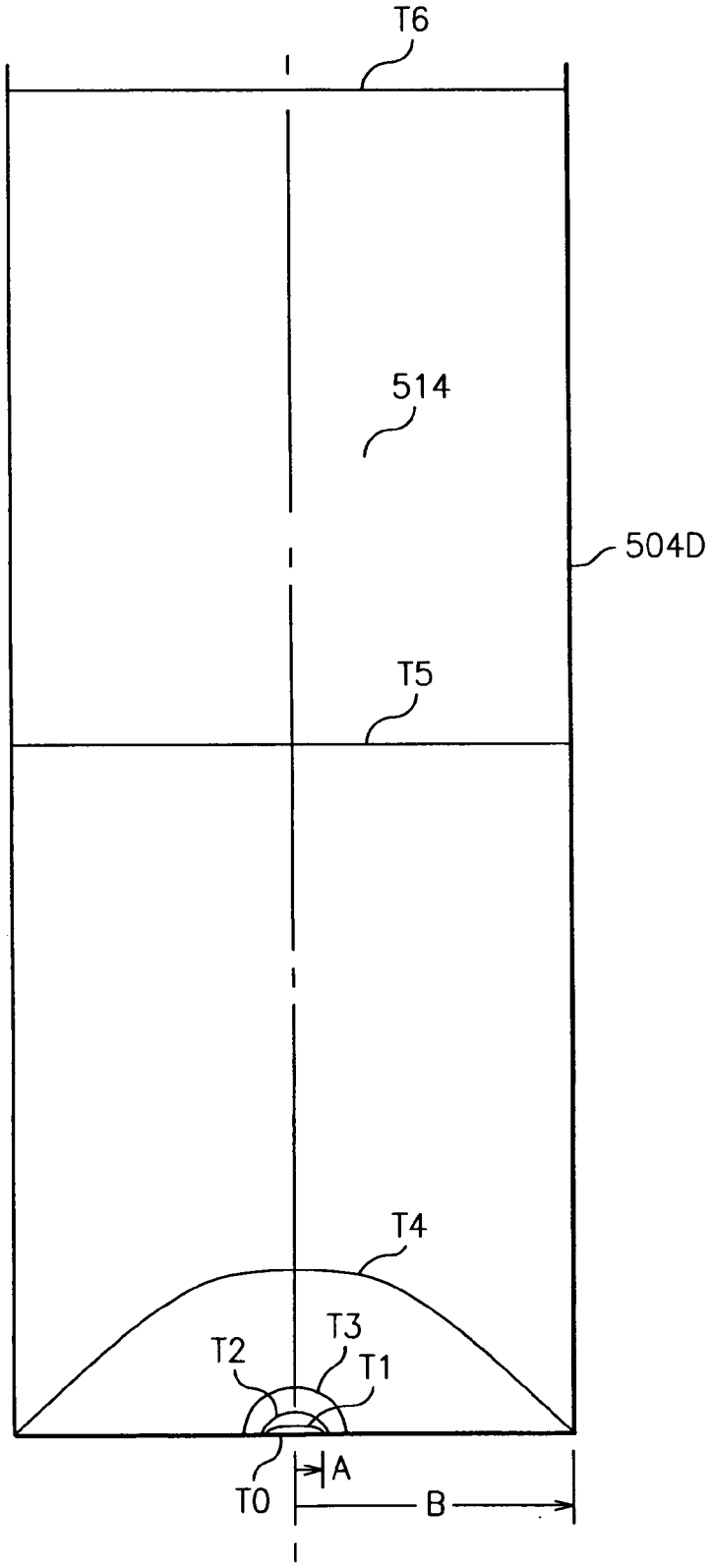
(PRIOR ART) Fig. 12
FIG. 12 shows prior-art temperature contours in a flux tube for equal intervals in temperature.

To help in the understanding of thermal conduction at a joint like that shown in FIG. 9 in a vacuum environment, consider the temperature distribution in a thermally conductive cylinder as shown in FIG. 12. The heat flux in this cylinder (called a flux tube in heat-transfer literature) represents the heat flux associated with one contact area. The temperature over radius A at the bottom is held at temperature T0, and represents a small thermal contact area over the same radius. The temperature at the top of the cylinder is T6 and there is no significant heat flow to any surface other than the top surface. Assuming constant thermal conductivity throughout the cylinder, the temperatures throughout the cylinder will be distributed as shown in FIG. 12 where $$T1-T0=T2-T1=T3-T3,\text{etc.} \tag{1}$$

The equal-temperature contours are concentrated near the contact area at the bottom of the cylinder where the temperature is held at T0. This concentration means that a substantial amount of the thermal resistance in the cylinder is concentrated at the same location.

The added thermal resistance due to the small contact area was first called the constriction resistance and later the spreading resistance, and was described by Negus, et al., in an ASME Paper No 84-HT-84 (1984). This article is incorporated herein by reference. The variation in spreading resistance with contact geometry is given therein by $$\phi=1-1.40978\epsilon+0.34406\epsilon^3+0.0435\epsilon^5 0.02271\epsilon^7, \tag{2}$$

where $$\phi=4kAR_c, \tag{3}$$

in which k is the thermal conductivity of the cylinder, A is the contact radius (as shown in FIG. 12), and $R_c$ is the constriction or spreading resistance, and $$\epsilon=A/B, \tag{4}$$

in which A and B are the contact and cylinder radii (as shown in FIG. 12). For the very low values of $\epsilon$ that are of interest herein, an accurate correlation is given by Yovanovich in the aforementioned article in the *IEEE Transactions on Components and Packaging Technologies,*

$$\phi=(1-\epsilon)^{1.5}. \tag{5}$$

Figure 13:
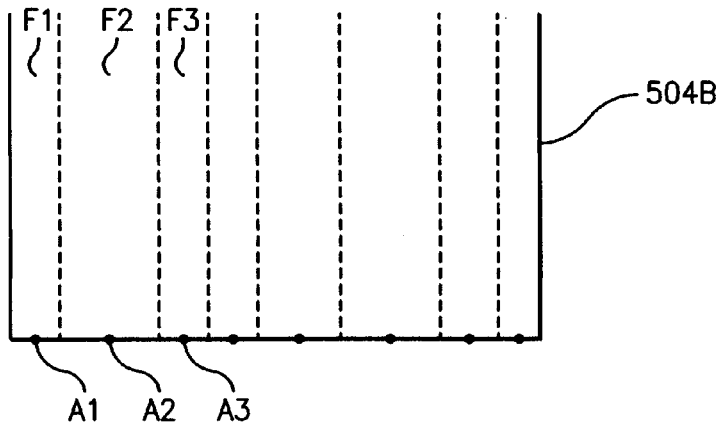
(PRIOR ART) Fig. 13
FIG. 13 shows a prior-art representation of an actual distribution of flux tubes F1, F2, F3, etc. for contact areas A1, A2, A3, etc.
Figure 14:
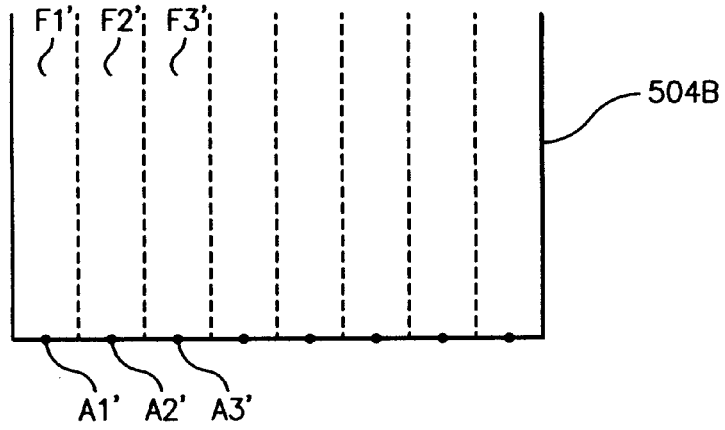
(PRIOR ART) Fig. 14
FIG. 14 shows a prior-art representation of the uniform distribution of flux tubes F1', F2', F3', etc. for contact areas A1', A2', A3', etc. that have the same mean value of area (A1'=A2'=A3', etc.)

Referring to FIG. 13, there is shown a representation of one member of a heat-transfer joint, in which there are contact areas A1, A2, A1, etc. of respective flux tubes F1, F2, F1, etc. There are variations in contact areas, the shapes of the contact areas, and the sizes of the associated flux tubes. As described by Yovanovich in the aforementioned article in the *IEEE Transactions on Components and Packaging Technologies* and by Yovanovich et al. in the aforementioned Chapter 4 in the *Heat Transfer Handbook*, it has been found that shape details of the contact areas are not important, and that accurate heat-transfer calculations can be made with the use of circular contact areas of a mean size and the corresponding selection of a mean size for flux tubes. Referring to FIG. 14, there is shown the representation of one member of a heat-transfer joint in which a mean size is used for all contact areas A1', A2', A3', etc. and a corresponding mean size for all flux tubes F1', F2', F3', etc. Equation (5) can be used for the spreading resistance associated with each of the contact areas.

The selection of the mean values depends on fundamental assumptions for the specific model used. The "plastic contact model" assumes all contacts result from plastic deformation of the surfaces and corresponds to the initial clamping together of two surfaces. This model is appropriate for ion sources where parts would be expected to be re-assembled after each maintenance with different micro-misalignments. Examination for the calculation procedure for this model also shows that the contact resistance is less for many small contacts, as opposed to a few large contacts. The force, F, in this model can be expressed in terms of either the apparent pressure, P, and apparent contact area, $A_a$, or the microhardness, H, and the real contact area, $A_r$ $$F=PA_a=HA_r. \tag{6}$$

If the two thermally conducting elements of a thermal joint are made of two different materials, the microhardness that should be used is for the material with the least microhardness. The real-to-apparent contact-area ratio can be obtained from the above equation and is $$A_r/A_a=P/H. \tag{7}$$

Figure 15:
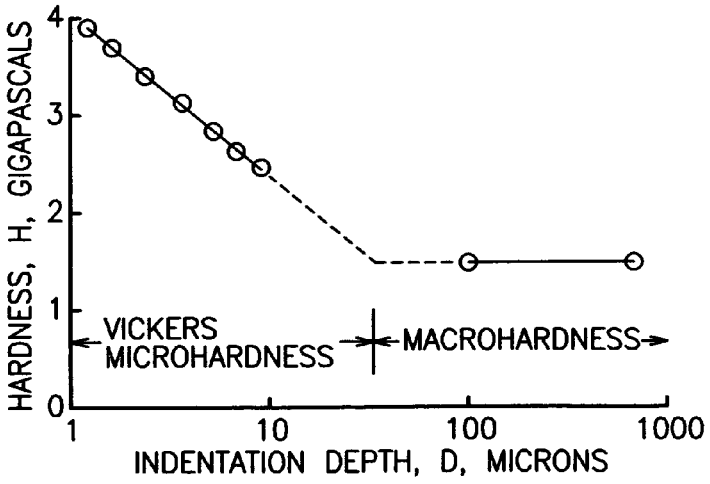
(PRIOR ART) Fig. 15
FIG. 15 shows the prior-art variation of hardness with depth of penetration for 304 stainless steel.

The microhardness is related to the bulk hardness. Referring to FIG. 15, there is shown both the bulk hardness and the microhardness of 304 stainless steel, a material that is widely used in vacuum chambers. It is necessary to use different hardness measuring techniques to measure hardness over a range of indentation depths. Vickers hardness is used for the microhardness measurements, while Brinell and Rockwell hardness measurements are used for macrohardness measurements. Additional details regarding the hardness measuring techniques are given by Yovanovich et al. in the aforementioned Chapter 4 in the *Heat Transfer Handbook*. The typical poor thermal contact of a vacuum joint can be illustrated with a simple calculation. If many small contacts are desired to maximize the heat transfer, as described above, then the scale of the roughness must be quite small, and the penetrations at the joint must also be quite small and the effective microhardness for 304 stainless steel would be about 4 gigaPascals. For a moderate apparent pressure of 2 megaPascals (equivalent to about 20 atmospheres), the real-to-apparent contact-area ratio would be about $5\times10^{-4}$. Examination of Eqs. (3) through (5) will show that the use of many small contacts (as opposed to a few large contacts) will partially offset this microscopic contact area, but its truly minuscule size illustrates the thermal conduction problem of a vacuum joint. As mentioned above, this obstacle can be overcome with the use of thermal transfer sheets, but at cost of introducing easily damaged additional components.

The microhardness is related to the bulk hardness, but it can be much larger. Examples of microhardness and bulk hardness are given by Yovanovich et al. in the aforementioned Chapter 4 in *Heat Transfer Handbook*, by Yovanovich, in an article in the *IEEE Transactions on Components and Packaging Technologies*, Vol. 28 (2005), beginning on page 182, and by Yovanovich, in *AIAA Paper* No. AIAA-2006-979 (2006). These are incorporated herein by reference.

Description of Preferred Embodiment

Figure 16:
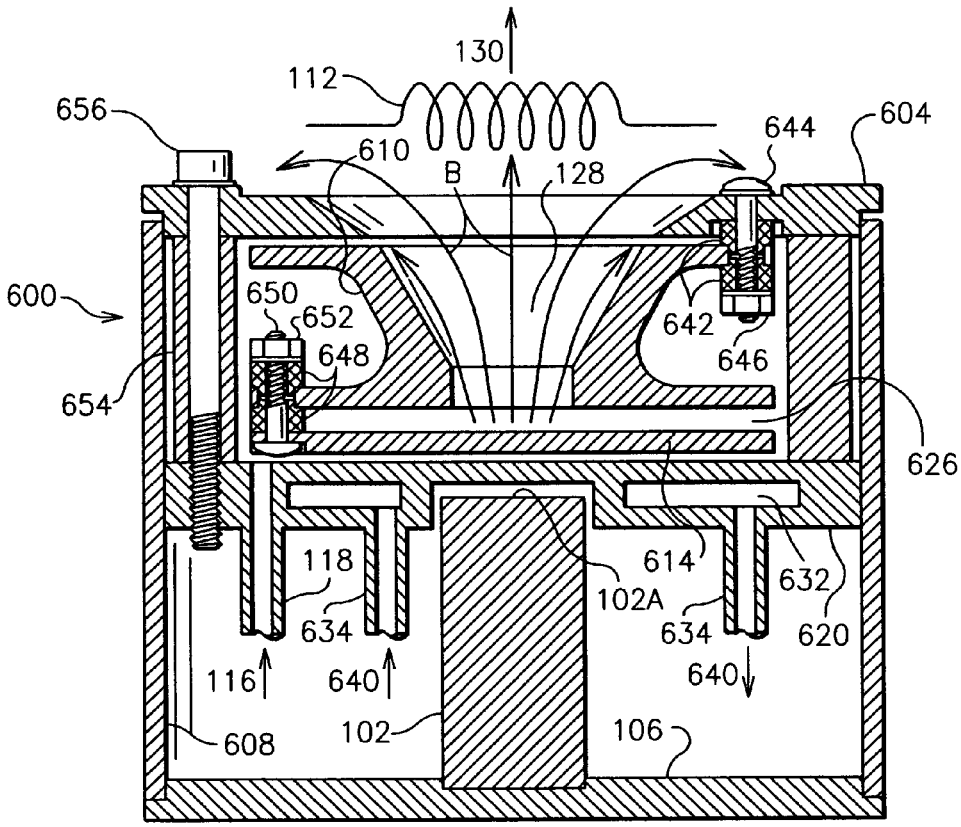
FIG. 16 shows the cross section of an end-Hall ion source incorporating an embodiment of the present invention.

Referring to FIG. 16, there is shown end-Hall ion source 600, an embodiment of the present invention. This source has a magnetic field similar to that of ion source 100 in FIG. 1. There is magnetic-field energizing means 102, which is again a permanent magnet. As described in connection with FIG. 1, this magnetic-field energizing means could also be an electromagnet. The top of permanent magnet 102 performs the function of internal pole piece 102A, but the internal pole piece could again be a separate piece of magnetically permeable material located on top of permanent magnet 102. The magnetic circuit includes magnetically permeable external pole piece 604, magnetically permeable base plate 106, and magnetically permeable cylindrical wall 608. The magnetic circuit with the magnetic-field energizing means generates magnetic field B between internal pole piece 102A and external pole piece 604.

Between anode 610 and internal pole piece 102A is reflector 614. Ionizable gas 116 is introduced through gas tube 118, attached to central plate 620. The gas flows around reflector 614 into gas distribution volume 626, and then into discharge volume 128. This path for the ionizable gas is different from that shown in FIG. 1, but the operation of the ion source is not affected significantly by this difference.

The electrical operation is also similar to that of ion source 100 shown in FIG. 1. The electron emitting means 112 is at a potential close to ground. Anode 610 is at a positive potential relative to ground—from several tens of Volts positive up to several hundreds of Volts positive. The electrons are attracted to the positive potential of anode 610. As the electrons enter discharge region 128 enclosed by anode 610, they gain sufficient kinetic energy to ionize atoms or molecules of ionizable working gas 116. The electrons are prevented from directly reaching the anode by magnetic field B, which is generated between internal pole piece 102A and external pole piece 604. Because of magnetic field B the electrons follow long, cycloidal paths in discharge region 128 before reaching anode 610, thereby permitting operation at a much lower pressure for the ionizable working gas in discharge region 128 than would be possible without the magnetic field. Some of the ions generated in the discharge region escape out the open end of this region toward electron emitting means 112 and, together with some of the electrons from electron emitting means 112, form neutralized ion beam 130. There are no significant differences in the generation and acceleration of ions in end-Hall ion source 600 compared to the same functions in the prior-art end-Hall ion sources.

The embodiment of the present invention shown in FIG. 16 differs from the prior art in the manner of cooling, which can be called an enhanced-radiation-cooled anode. Central plate 620 has internal passages 632 with attached tubes 634. Cooling fluid 640 flows through tubes 634 and internal passages 632. Anode 610 is supported by external pole piece 604, using pluralities of electrical insulators 642, screws 644, and nuts 646. In a similar manner reflector 614 is supported by anode 610, using pluralities of insulators 648, screws 650, and nuts 652.

Still referring to FIG. 16, central plate 620 is cooled by cooling fluid 640, usually water, flowing through internal passages 632. Cylinder 654 is cooled by contact to central plate 620, and external pole piece 604 is cooled by contact with cylinder 654. External pole piece 604, cylinder 654, and central plate 620 are held together with a plurality of assembly units, which in this case are screws 656. Screws 656 are the only components that require a torque measurement. Keeping in mind the small real-to-apparent contact-area ratios that can be encountered in vacuum joints, and the associated high contact resistances, at least one of the two elements at each joint was selected to be a material with low microhardness. That is, at least one of central plate 620 and cylinder 654 must be of a material with low microhardness. And at least one of cylinder 654 and external pole piece 604 must be of a material with low microhardness. Microhardness is described by Yovanovich in both the aforementioned article in the *IEEE Transactions on Components and Packaging Technologies* and in the aforementioned AIAA Paper No. AIAA-2006-979 (2006). A material with a low microhardness is defined herein as having a maximum value of Vickers microhardness, corresponding to an indentation depth of about 1 μm, of about 1 Gpa or less. Examples without limitation of materials with a low microhardness are lead, tin, silver, copper, and aluminum. Although commercially pure aluminum would also have a low microhardness, the aluminum referred to here is aluminum 6061-T6, which is a widely used alloy.

In the configuration of ion source 600, the hot anode and hot reflector are supported by insulators with small contact areas between the insulators and the hot parts, with no special treatment of the contact areas. The result is that there is negligible conductive heat transfer from these hot parts. The parts surrounding the hot anode and hot reflector are cooled to enhance the radiation heat transfer from the hot parts. Cylinder 654 and central plate 620 together form a thermally conductive cup that surrounds the hot anode and hot reflector, with cylinder 654 forming the side wall of this cup and central plate 620 forming the closed end. Cylinder 654 is in thermal contact with and cools external pole piece 604, which completes the cooled enclosure surrounding the hot parts, except for the opening in the external pole piece for the ions to escape. Note that in the radiation-cooled configuration shown in FIG. 1, the parts surrounding the anode and reflector are heated by the radiation and then serve as radiation shields to reduce the net radiation heat transfer. To further enhance radiation heat transfer in ion source 600, the surfaces of the anode and reflector and the surfaces of elements 604, 620, and 654 that face the anode and reflector can all be optically roughened to increase their radiation emissivities and absorptivities. The light reflected from an optically roughened does so in a diffuse, not a specular manner. Optically roughening can be done in different ways. It can be done mechanically by grit or abrasive blasting, in which abrasive particles are blown at the surface to be roughened with compressed air. It can also be done chemically by oxidizing the surface to be roughened. Optical roughening can increase the emissivity or absorptivity of a metal surface from 0.1-0.2 for a polished metal surface to 0.5-0.6 or even more for a roughened surface. After the heat is transferred to central plate 620, cylinder 654, and external pole piece 604, these parts are cool enough that radiation from them is negligible and the heat is essentially all carried away by the cooling fluid.

It may be noted that there are other apparent paths for conductive heat transfer in ion source 600, but practical considerations, together with the difficulty of conducting heat across a joint in vacuum, make the heat conduction through these paths negligible. For example, external pole piece 604 is in contact with cylindrical wall 608. But the external pole piece is required to be in a controlled contact with cylinder 654. To make sure that the external pole piece presses against cylinder 654 instead of cylindrical wall 608, it is necessary to make the cylindrical wall short enough that there is no force between the external pole piece and the cylindrical wall when screws 656 are tightened. Further, the external pole piece and the cylindrical wall must be separated during maintenance, so there must be a radial clearance between these parts. While these parts are close enough for adjacent parts in a magnetic circuit, the absence of any significant force between the two assures that there will be essentially no conductive heat transfer between them in a vacuum.

There is another feature of the embodiment of FIG. 16 that should be pointed out. The assembly elements that hold central plate 620, cylinder 654, and external pole piece 604 together are screws 656. These screws pass through cylinder 654 and will have approximately the same temperature as that cylinder. If the cylinder is constructed of a material with a higher coefficient of thermal expansion than the screws passing through it, the tension in the screws will increase as the temperatures of the cylinder and screws increase. This means that, if the screws are not tightened enough during assembly, and the cylinder is not cooled adequately by the central plate due to low contact pressure, the contact pressure will increase as operation is started and the cylinder heats up. This feature makes the cooling effectiveness of this embodiment less sensitive to the torques used to tighten the screws.

An example of the configuration shown in FIG. 16 was constructed using copper for central plate 620, aluminum alloy 6061-T6 for cylinder 654, and 410 stainless steel, annealed, for external pole piece 604. Thermocouples were attached to the outer edges of the anode and reflector, both sides of the central-plate/cylinder joint and both sides of the cylinder/external-pole-piece joint, as well as to the magnet and other components. Water was used as the coolant. Screws 656 were 6.35 mm in diameter and were tightened with a torque wrench to 28 kg-cm. The effectiveness of the use of low microhardness elements at heat transfer joints was shown by temperature measurements when the ion source of FIG. 16 was operated with a discharge power of 3000 W. All the ion-source parts except external pole piece 604, anode 610, and reflector 614 were at or below 140° C. The thermocouple on the external pole piece only reached 260° C. The hottest parts were the anode at 960° C. followed by the reflector at 760° C.

Aluminum alloy cylinder 654 has a higher coefficient of thermal expansion than the plurality of 18-8 stainless steel screws 656 passing through it—about 50 percent higher. To test the effectiveness of this difference in thermal expansion coefficient in correcting for a reduction in tightening torque, the ion source was disassembled, then reassembled with a torque of only 14 kg-cm for screws 656. It was then operated at the same power described above for the higher torque. The average of the top and bottom temperatures for cylinder 654 only increased by 45°, from 125° C. to 170° C. The temperature of external pole piece 604, affected both by a slightly reduced clamping force and a higher temperature for the aluminum cylinder, increased by 120°, from 260° C. to 380° C. The temperature of the anode was, within experimental error, the same, while the temperature of the reflector increased by only about 10°. These small differences for the anode and reflector are consistent with the small amount of energy radiated back to the anode and reflector at the temperatures of the cylinder and external pole piece. The results of this test showed a lack of sensitivity to tightening torque, which in practice can be expected to result in fewer problems and more reliable operation.

This enhanced radiation cooling can be compared to the configuration with the indirect-conduction-cooled anode that is shown in FIG. 4. The latter had an anode temperature of over 1000° C. with a 3000 W discharge power and a cooler hollow-cathode electron emitter. The ion source shown in FIG. 16 is approximately the same diameter (14.5 cm for ion source 600 versus 14 cm for ion source 400) and is simpler to assemble (one tightening sequence for ion source 600 with a torque wrench versus three for ion source 400) without the need for fragile electrically insulating thermal transfer interface components of ion source 400 and the thermal transfer sheets of the aforementioned anonymous technical manual. The anode temperature is actually lower for the simpler, more rugged design of FIG. 16.

Alternative Embodiments

In one alternative embodiment at least one of the two elements at a joint must be plated, brazed, or otherwise have attached to it a layer at least several tens of microns thick of material having a low microhardness. Lead and tin may not be suitable for constructing entire elements (e.g., central plate 620 or cylinder 654). On the other hand, the weaker materials may still be suitable for layers of material that are plated, brazed, welded, sputter deposited, or otherwise permanently attached to an element such as the central plate or the cylinder at a joint. Depending on details of the ion source design and the application for which it is used, other factors such as vapor pressure of the low microhardness material may also be important.

Figure 17A:
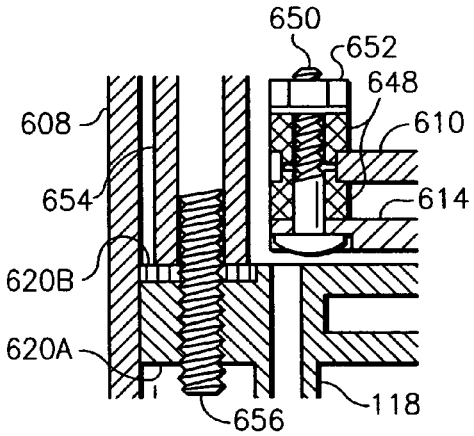
FIG. 17(*a*) shows the local cross section of an end-Hall ion source otherwise similar to that in FIG. 16 in which central plate 620 has been replaced with central plate 620A and which further has a layer of low microhardness material 620B permanently attached to central plate 620A.
Figure 17B:
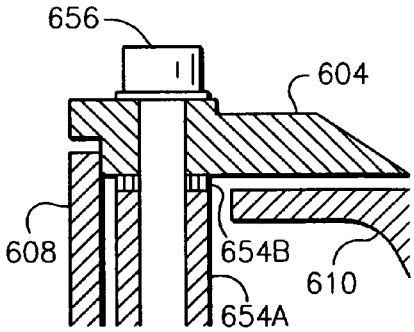

Referring to FIG. 17(*a*), there is shown an enlarged view of a portion of an embodiment of the present invention similar to that shown in FIG. 16, except that a layer of material having a low microhardness, layer 620B, is attached to central plate 620A. The layer of material having a low microhardness could have been attached instead to cylinder 654, or layers could have been attached to both the central plate and the cylinder.

Referring to FIG. 17(*b*), there is shown another enlarged view of a portion of an embodiment of the present invention similar to that shown in FIG. 16, except that a layer of material having a low microhardness, layer 654B, is attached to cylinder 654A. The layer of material having a low microhardness could have been attached instead to external pole piece 604, or layers could have been attached to both the cylinder and the external pole piece.

Figure 18:
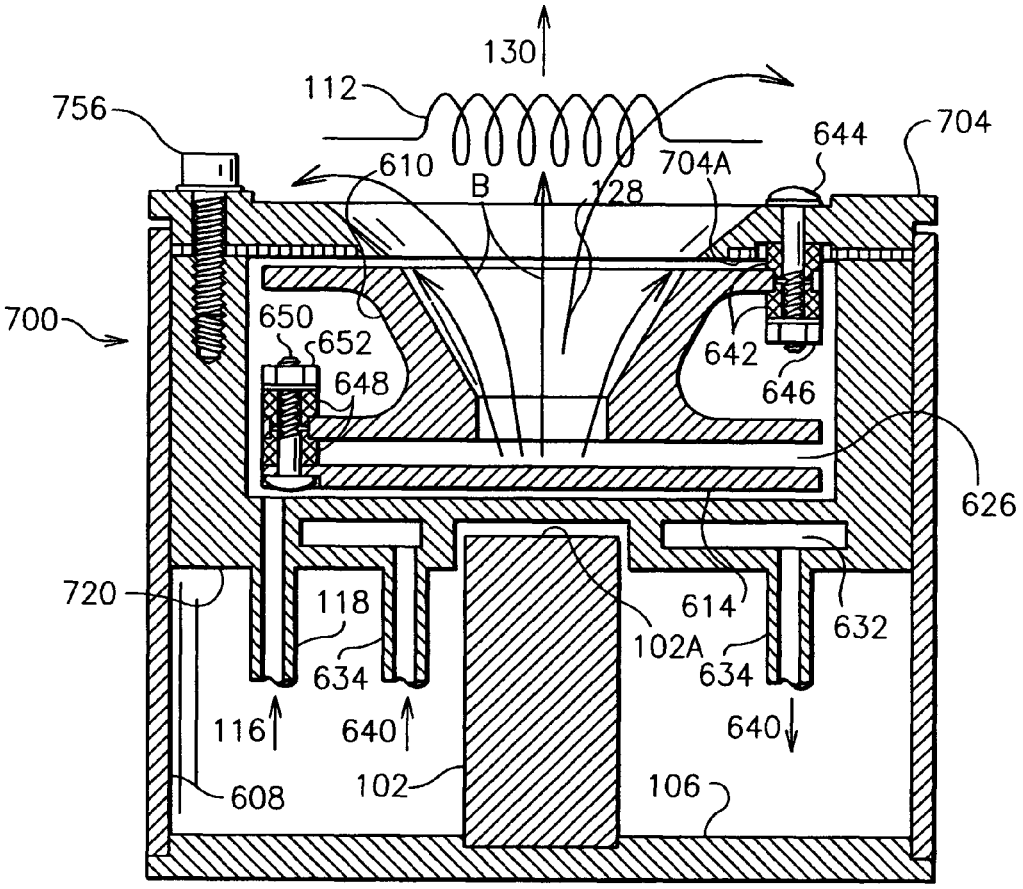
FIG. 18 shows the cross section of an end-Hall ion source incorporating an alternate embodiment of the present invention.

Referring to FIG. 18, there is shown end-Hall ion source 700, another alternative embodiment of the present invention. Ion source 700 differs from ion source 600 in FIG. 16 in that cylinder 654 and central plate 620 in FIG. 16 are combined into a single integral element, thermally conductive cup 720 in FIG. 18. Screws 756 that hold the external pole piece to this single integral element are shorter than screws 656 used in ion source 600. It also differs from ion source 600 in having a large area of external pole piece 704 (more than half the area of that side of 704) covered with layer 704A having higher thermal conductivity than the thermal conductivity of external pole piece 704. The advantage of incorporating layer 704A is that it lowers the average temperature of the radiation environment surrounding anode 610 and reflector 626, hence will reduce the temperatures of the anode and reflector. In the case of a thermally conducting layer such as 704A, the thermal benefit would require a layer much thicker than a few tens of microns.

Figure 19:
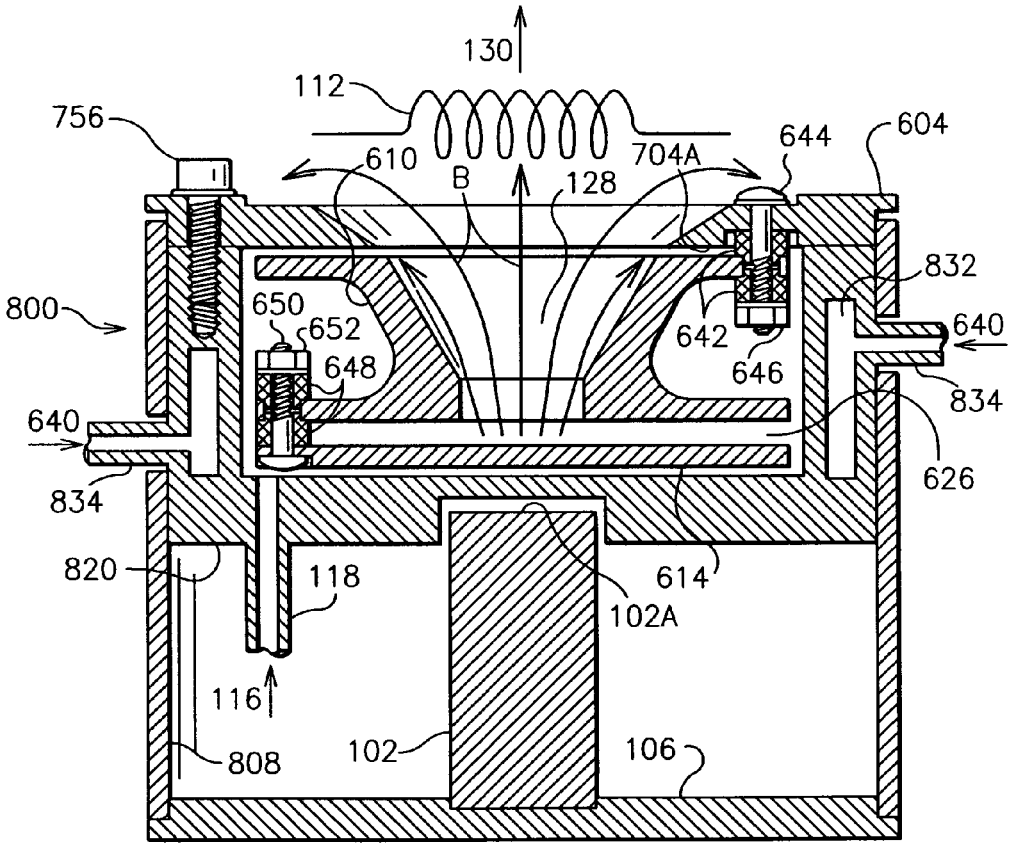
FIG. 19 shows the cross section of an end-Hall ion source incorporating another alternate embodiment of the present invention.

Referring to FIG. 19, there is shown end-Hall ion source 800, yet another alternative embodiment of the present invention. The cylinder and central plate are again combined into a single integral element, thermally conductive cup 820. In this embodiment, however, the internal passages through which a cooling fluid can flow (passages 832) are in the cylinder part of the cup instead of the closed end. As described above, the cylinder and closed end form a single integral element. The side wall and closed end could also be separable, one from the other, with the cooling passages still in the side wall.

While particular embodiments of the present invention have been shown and described, and various alternatives have been suggested, it will be obvious to those skilled in the art that changes and modifications may be made without departing from the invention in its broadest aspects. Therefore, the aim in the appended claims is to cover all such changes and modifications as fall within the true spirit and scope of that which is patentable.

What is claimed is:

1. An end-Hall ion-source apparatus comprising:

(a) an ion generating means comprising;

(i) a discharge region having a first end, a second end, and a side, wherein said first end is open (ii) an electron emitting means located outside of said discharge region;

(iii) an anode which encloses said discharge region at said side;

(iv) a reflector, which encloses said discharge region at said second end;

(v) means for introducing an ionizable working gas into said discharge region;

(b) magnetic-circuit means comprising;

(i) a magnetically permeable internal pole piece located outside of said second end of said discharge region and near said reflector;

(ii) an magnetically permeable and thermally conductive external pole piece located around said first end of said discharge region and between said anode and said electron emitting means;

(iii) a magnetically permeable path between said internal pole piece and said external pole piece;

(iv) a magnetic-field generating means located in said magnetically permeable path;

(c) a cooling means comprising a thermally conductive cup having a closed end, a side wall, an open end, and internal passages through which fluid can flow; wherein said cup encloses said anode and said reflector; wherein said closed end is located between said reflector and said internal pole piece; wherein said cup and said external pole piece are in physical contact with each other; and wherein at least one of said cup and said external pole piece is comprised of a material with a low microhardness; and (d) assembly means holding said cup against said external pole piece.

2. The end-Hall ion-source apparatus of claim 1, wherein said cup includes a first surface and said external pole piece includes a second surface in contact with said first surface of said cup; wherein at least one of said first and second surfaces is comprised of a thermally conductive low microhardness layer that is permanently attached to said cup or said external pole piece.

3. The end-Hall ion-source apparatus of claim 1, wherein said external pole piece has a surface which is comprised of a thermally conductive, low microhardness layer permanently attached to said surface; wherein said external pole piece has a first thermal conductivity; wherein said low microhardness layer has a second thermal conductivity that is greater than said first thermal conductivity and covers more than half of said surface of said external pole piece.

4. The end-Hall ion-source apparatus of claim 1, wherein said external pole piece includes a first plurality of holes located around said first end of said discharge region; wherein said side wall of said cup includes a second plurality of holes having locations corresponding respectively to the locations of said first plurality of holes in said external pole piece; wherein said cup has a first thermal expansion coefficient; wherein said assembly means comprises a plurality of assembly elements having a second thermal expansion coefficient and extending through said first and second pluralities of holes to hold said external pole piece in physical contact with said cup; wherein said first thermal expansion coefficient is greater than said second thermal expansion coefficient.

5. The end-Hall ion-source apparatus of claim 1, wherein said side wall and said closed end can be separated from each other, and wherein at least one of said side wall and said closed end of said cup has internal passages through which a fluid can flow, and wherein at least one of said side wall and said closed end of said cup has a low microhardness.

6. The end-Hall ion-source apparatus of claim 5, wherein said side wall of said cup and said external pole piece are in physical contact; wherein at least one of said side wall, said closed end and said external pole piece has a low microhardness.

7. The end-Hall ion-source apparatus of claim 5, wherein said side wall and said closed end are in physical contact with each other; wherein said side wall includes a first surface and said external pole piece includes a second surface in physical contact with said first surface; wherein at least one of said first and second surfaces is comprised of a thermally conductive layer that has been permanently attached thereto; wherein said layer has a low microhardness; and wherein at least one of said side wall and said closed end has a low microhardness.

8. The end-Hall ion-source of claim 7, wherein said side wall and said external pole piece are in physical contact with each other; wherein said closed end includes a third surface which is in contact with a fourth surface on said side wall; wherein at least one of said third and fourth surfaces is comprised of a thermally conductive layer permanently attached thereto; wherein each said thermally conductive layer has a low microhardness.

9. The end-Hall ion-source apparatus of claim 5, wherein said side wall of said cup exhibits said first thermal expansion coefficient; further comprising a third plurality of holes in said closed end having locations corresponding respectively to the locations of said second plurality of holes; wherein said side wall and said external pole piece are in physical contact with each other; wherein said side wall and said closed end are in physical contact with each other; wherein said plurality of assembly elements extend through said first, second and third plurality of holes in said external pole piece, said side wall, and said closed end of said cup to hold said external pole piece, side wall and closed end together in physical contact.

10. The end-Hall ion-source apparatus of claim 1, wherein one or more of the surfaces of said anode or said reflector are optically roughened.

11. The end-Hall ion-source apparatus of claim 1, wherein the surfaces of said external pole piece or said cup facing said anode or said reflector are optically roughened.

12. An end-Hall ion-source apparatus comprising:

(a) an ion generating means comprising:
- (i) a discharge region having a first end, a second end, and a side, wherein said first end is open;
- (ii) an electron emitting means, located outside of said discharge region;
- (iii) an anode which encloses said discharge region at said side;
- (iv) a reflector which encloses said discharge region at said second end;
- (v) means for introducing an ionizable working gas into said discharge region;

(b) magnetic-circuit means comprising:
- (i) a magnetically permeable internal pole piece located outside of said second end of said discharge region and near said reflector;
- (ii) a magnetically permeable and thermally conductive external pole piece, having a first thermal conductivity, and located around said first end of said discharge region and between said anode and said electron emitting means;
- (iii) a magnetically permeable path between said internal pole piece and said external pole piece; and
- (iv) a magnetic-field generating means located in said magnetically permeable path;

(c) a cooling means comprising a cup having a thermally conductive closed end, a thermally conductive side wall, and an open end; wherein said side wall and said closed end can be separated, and at least one of said side wall and said closed end has internal passages through which a fluid can flow; wherein said cup encloses said anode and said reflector, with said closed end located between said reflector and said internal pole piece; wherein said side wall and said closed end are in physical contact with each other; wherein at least one of said closed end and said side wall has a low microhardness; wherein said external pole piece includes a surface which faces said cup, and wherein said surface is comprised of a thermally conductive layer having a low microhardness; wherein said layer is permanently attached to said external pole piece and covers more than half of said surface of said external pole piece facing said cup; wherein said layer has a second thermal conductivity which is greater than said first thermal conductivity;

(d) assembly means holding said closed end of said cup against said side wall of said cup and holding said side wall of said cup against said external pole piece.

13. A method for constructing an end-Hall ion source, the method comprising the steps of:

(a) providing a discharge region having a first end, a second end, and a side, wherein said first end is left open;

(b) providing an electron emitting means and locating it outside of said discharge region;

(c) providing an anode and enclosing said discharge region at said side with said anode;

(d) providing a reflector and enclosing said discharge region at said second end with said reflector;

(e) providing a means for introducing an ionizable gas into said discharge region;

(f) providing a magnetically permeable inner pole piece and locating it outside of said second end of said discharge region and near said reflector;

(g) providing a magnetically permeable and thermally conductive external pole piece and locating it around said first end of said discharge region and between said anode and said electron emitting means;

(h) providing a magnetically permeable path between said internal pole piece and said external pole piece;

(i) providing a magnetic-field generating means and locating it in said magnetically permeable path;

(j) providing a thermally conductive low microhardness cup having an open end, a side wall, and a closed end, and having internal passages through which a fluid can flow;

(k) locating said cup with said closed end between said reflector and said internal pole piece, wherein said side wall encloses said anode and is in contact with said external pole piece; and (l) providing assembly means for holding said side wall of said cup against said external pole piece.

14. The method of claim 13, wherein said side wall and said closed end are separable from each other; and wherein at least one of said side wall and said closed end has a low microhardness.

15. The method of claim 14, wherein said external pole piece includes a first plurality of holes therethrough; wherein said side wall has a first thermal expansion coefficient and a second plurality of holes in locations corresponding respectively to said first plurality of holes; wherein said closed end has a third plurality of holes in locations corresponding respectively to said second plurality of holes; wherein said assembly means comprises a plurality of assembly elements having a second thermal expansion coefficient which is lower than said first thermal coefficient; wherein said assembly elements extend through said first, second and third plurality of holes to hold said closed end, said side wall, and said external pole piece together.

16. The method in accordance with claim 13, wherein one or more surfaces of said anode or said reflector is optically roughened.

17. The method in accordance with claim 13, wherein the surfaces of said external pole piece or cup which are exposed to said anode or reflector are optically roughened.

* * * * *